US007938229B2

(12) United States Patent
Davies

(10) Patent No.: US 7,938,229 B2
(45) Date of Patent: May 10, 2011

(54) MARINE EMERGENCY ROPE LADDER APPARATUS

(76) Inventor: Rebecca M. Davies, Madras, OR (US)

( * ) Notice: Subject to any disclaimer, the term of this patent is extended or adjusted under 35 U.S.C. 154(b) by 658 days.

(21) Appl. No.: 11/899,714

(22) Filed: Sep. 7, 2007

(65) Prior Publication Data

US 2009/0065303 A1 Mar. 12, 2009

(51) Int. Cl.
*E06C 1/56* (2006.01)

(52) U.S. Cl. ..... 182/196; 182/70; 182/82; 182/194; 114/362

(58) Field of Classification Search ..... 182/70, 182/82, 196; 114/362
See application file for complete search history.

(56) References Cited

U.S. PATENT DOCUMENTS

| | | | | | |
|---|---|---|---|---|---|
| 199,967 | A | * | 2/1878 | Elton | 182/196 |
| 277,672 | A | * | 5/1883 | Brendel | 182/196 |
| 471,329 | A | * | 3/1892 | Perry | 182/196 |
| 641,741 | A | * | 1/1900 | Travers | 182/196 |
| 848,640 | A | * | 4/1907 | Dalton | 182/196 |
| 966,447 | A | * | 8/1910 | Huff | 182/196 |
| 2,518,839 | A | * | 8/1950 | Thonney | 182/196 |
| 3,008,537 | A | * | 11/1961 | Roberts et al. | 182/196 |
| 3,128,843 | A | * | 4/1964 | Anagnostou | 182/198 |
| 3,692,145 | A | * | 9/1972 | Banner | 182/70 |
| 4,127,184 | A | * | 11/1978 | Strohmeyer | 182/70 |
| 4,405,034 | A | | 9/1983 | Dunne | 182/190 |
| 4,445,589 | A | * | 5/1984 | Longenecker | 182/76 |
| 4,471,854 | A | | 9/1984 | Heilskov | 182/196 |
| 4,531,612 | A | * | 7/1985 | Sandor | 182/196 |
| 4,747,797 | A | | 5/1988 | Hindle | 441/38 |
| 4,788,926 | A | * | 12/1988 | Ullman et al. | 114/219 |
| 4,811,817 | A | * | 3/1989 | Geary | 182/76 |
| 4,852,688 | A | * | 8/1989 | Strohmeyer, Sr. | 182/199 |
| 5,020,633 | A | * | 6/1991 | Rangel | 182/70 |
| 5,074,236 | A | * | 12/1991 | Robertson | 114/362 |
| D355,886 | S | * | 2/1995 | Finn | D12/317 |
| 5,467,841 | A | * | 11/1995 | Krumal | 182/70 |
| D370,736 | S | * | 6/1996 | Douglas et al. | D25/64 |

(Continued)

OTHER PUBLICATIONS

"Knotted Bathing Ladder," p590 *The Ashley Book of Knots*, Doubleday & Co. (1944).

(Continued)

*Primary Examiner* — Katherine Mitchell
*Assistant Examiner* — Colleen M Quinn
(74) *Attorney, Agent, or Firm* — Larry J. Guffey

(57) ABSTRACT

An improved marine emergency rope ladder apparatus includes: (a) a continuous piece of rope knotted so as to form a safety ladder having a top and a bottom-free end, two side pieces that form a loop at the top of the ladder which is used to attach the top of the ladder to the surface to which it is to be affixed, and a plurality of rungs extending between these side pieces, (b) a pull rope whose top end is attached proximate the free end of the ladder and whose length is such that its bottom end is place proximate a water surface to which the ladder is to be extended, (c) a covering for the ladder in the form of a sleeve with a top flap and a means for releasably connecting the covering's bottom portion so that it can support the weight of the ladder fitted within the covering, and wherein this releasable means is configured so that a pull on the pull rope causes the releasable means to open the covering's bottom so as to allow the free end of the ladder to fall to the water below.

10 Claims, 5 Drawing Sheets

U.S. PATENT DOCUMENTS

| | | | | |
|---|---|---|---|---|
| 5,746,287 | A * | 5/1998 | Durham, Jr. | 182/70 |
| 6,015,027 | A * | 1/2000 | Banks | 182/70 |
| 6,102,155 | A * | 8/2000 | Hood et al. | 182/76 |
| 6,135,239 | A * | 10/2000 | Martin et al. | 182/70 |
| 6,182,598 | B1 * | 2/2001 | Bozzo | 114/362 |
| 6,328,129 | B1 * | 12/2001 | Ferguson | 182/70 |
| 6,382,352 | B1 | 5/2002 | Dowe | 182/70 |
| 6,888,942 | B2 | 3/2005 | Barzilia | 182/77 |
| 6,899,582 | B1 | 5/2005 | Hayles | 441/80 |
| 7,014,594 | B2 | 3/2006 | Stoltz | 482/24 |
| 7,455,028 | B2 * | 11/2008 | Baker | 114/362 |
| 7,458,334 | B2 * | 12/2008 | Baker | 114/362 |
| 2006/0076186 | A1 * | 4/2006 | Lindqvist | 182/70 |

OTHER PUBLICATIONS

Plastimo Safety Ladder, Model No. 3761384, available from Navimo USA, Sarasota, FL, at http://www.plastimousa.com/index.htm.

* cited by examiner

MARINE EMERGENCY ROPE LADDER APPARATUS

BACKGROUND OF THE INVENTION

1. Field of the Invention

The present invention relates generally to safety ladders and, more particularly, to a deployable ladder that will allow an overboard sailor to easily get back onboard his/her boat or an adjoining pier or dock.

2. Description of the Related Art

One who is alone and has fallen off a boat can, depending on the boat's location, face a very real and significant threat of drowning. Without someone to throw a floatation device or rope to the overboard sailor, and, as is often the case, with no means to reboard the boat, survival in the water, especially cold water, can be a daunting task.

Other than an occasional, deployed anchor line or an especially installed, boarding ladder that might extend to near the water's surface, few marine vessels have any structures near their water lines that an overboard sailor can grasp to stay afloat or use in trying to reboard a boat.

Some marine safety ladders do exist to aid the overboard sailor, but these apparently have deficiencies which are preventing their widespread use. See, for example, Plastimo Safety Ladder, Model No. 3761384, available from Navimo USA, Sarasota, Fla., at http://www.plastimousa.com/index.htm, or various rope ladders, such as "Knotted Bathing Ladder," p 590, *The Ashley Book of Knots*, Doubleday & Co. (1944).

The patent literature that might be considered relevant to this topic includes

U.S. Pat. Nos. 4,405,034, 4,747,797, 4,471,854, 6,382,352, 6,868,942, 6,899,582 and 7,014,594.

Thus, despite the existence of numerous marine safety devices, the continuing annual number of drowning deaths of overboard sailors suggests that is a need for improved, deployable-from-the-water, marine safety ladders.

3. Objects and Advantages

There has been summarized above, rather broadly, the prior art that is related to the present invention in order that the context of the present invention may be better understood and appreciated. In this regard, it is instructive to briefly consider the objects and advantages of the present invention.

It is an object of the present invention to provide an improved, deployable-from-the-water, marine safety ladder.

It is also an object of the present invention to provide an improved marine safety ladder that can be easily used by an overboard sailor.

It is a further an object of the present invention to provide a marine safety ladder which is easily attached to a boat's exterior and deployable by an overboard sailor so as to provide the sailor with a means for reboarding the boat.

These and other objects and advantages of the present invention will become readily apparent as the invention is better understood by reference to the accompanying summary, drawings and the detailed description that follows.

SUMMARY OF THE INVENTION

Recognizing the need for the development of improved, marine safety ladders, the present invention is generally directed to satisfying the needs set forth above and overcoming the limitations seen in the prior art, marine safety ladders.

In accordance with a preferred embodiment of the present invention, an improved marine emergency rope ladder apparatus includes: (a) a continuous piece of rope knotted so as to form a safety ladder having a top and a bottom-free end, two side pieces that form a loop at the top of the ladder which is used to attach the top of the ladder to the surface to which it is to be affixed, and a plurality of rungs extending between the side pieces, (b) a pull rope whose top end is attached proximate the free end of the ladder and whose length is such that its bottom end is place proximate a water surface to which the ladder is to be extended, (c) a covering for the ladder in the form of a sleeve with a top flap and a means for releasably connecting the covering's bottom portion so that it can support the weight of the ladder fitted within the covering, and wherein this releasable means is configured so that a pull on the pull rope causes the releasable means to open the covering's bottom so as to allow the free end of the ladder to fall to the water below.

Thus, there has been summarized above, rather broadly and understanding that there are other preferred embodiments which have not been summarized above, the present invention in order that the detailed description that follows may be better understood and appreciated.

DESCRIPTION OF THE PREFERRED EMBODIMENT

Figure 1A:
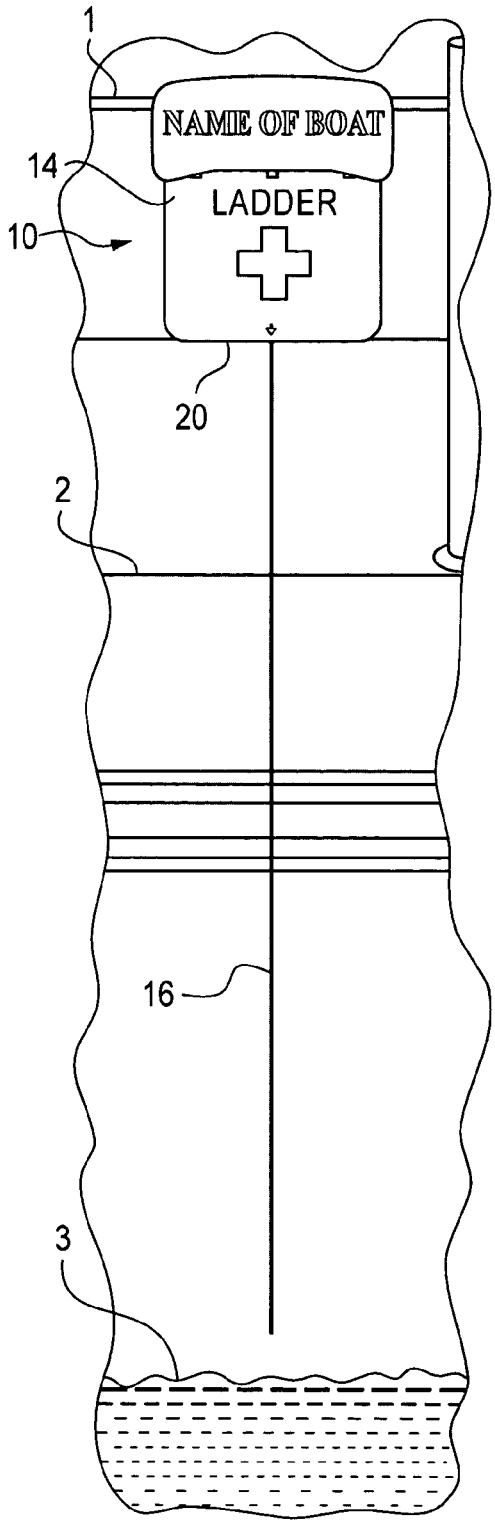
FIG. 1A illustrates a preferred embodiment of the present invention's safety rope ladder that has been hung on a horizontal boat railing and bundled into its protective canvas case, with the invention's pull rope extending down to a point just above the top of the water.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The present invention remedies the main problem with most marine safety ladders and their means of attachment to a boat—they are not deployable by an overboard sailor.

Figure 1B:
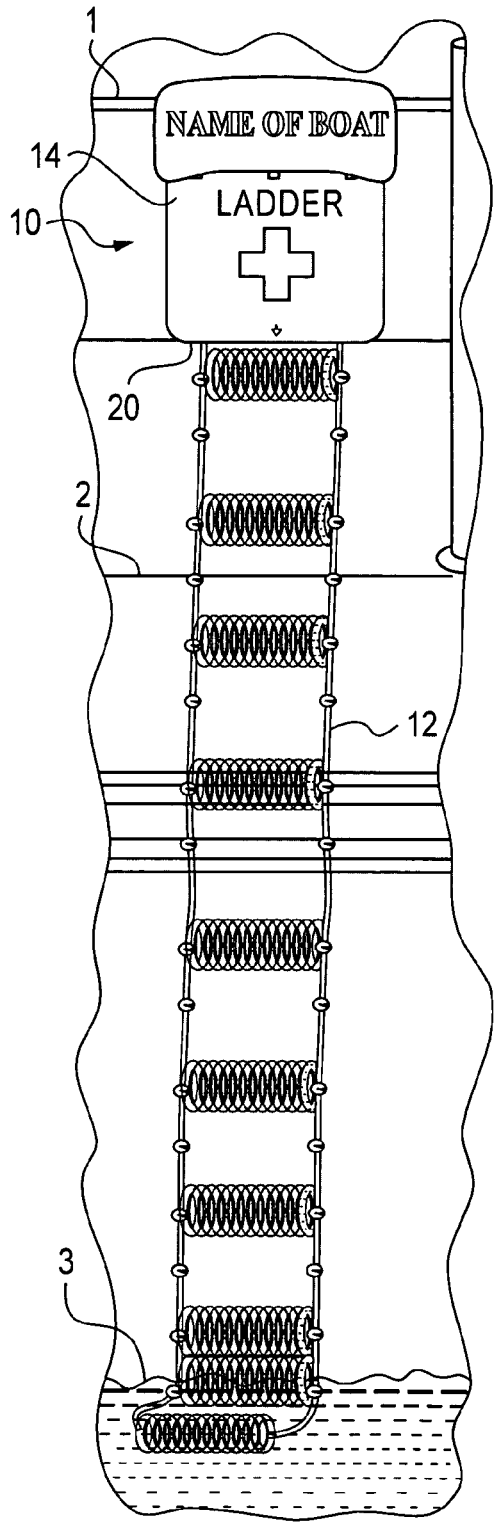
FIG. 1B illustrates the safety rope ladder shown in FIG. 1A after the pull rope and has been pulled and allowed the free end of the safety ladder to fall down into the water.

FIGS. 1A and 1B show a first preferred embodiment of the present invention's marine emergency rope ladder apparatus 10 in the form of a rope safety ladder 12 and its protective covering or case 14. The invention 10 is mounted on a horizontal railing 1 of a boat 2 which floats on the water's surface 3. FIG. 1A illustrates the situation when the ladder 12 is bundled into its protective case 14 and 18 with a pull rope 16 which is attached to the ladder's free end 18 and which extends down to a point just above the top of the water 3. Meanwhile, FIG. 1B illustrates the situation that exists after, for example, an overboard sailor has pulled the pull rope 16 and caused the ladder's free end to fall from the bottom 20 of the case and down into the water.

Figure 2A:
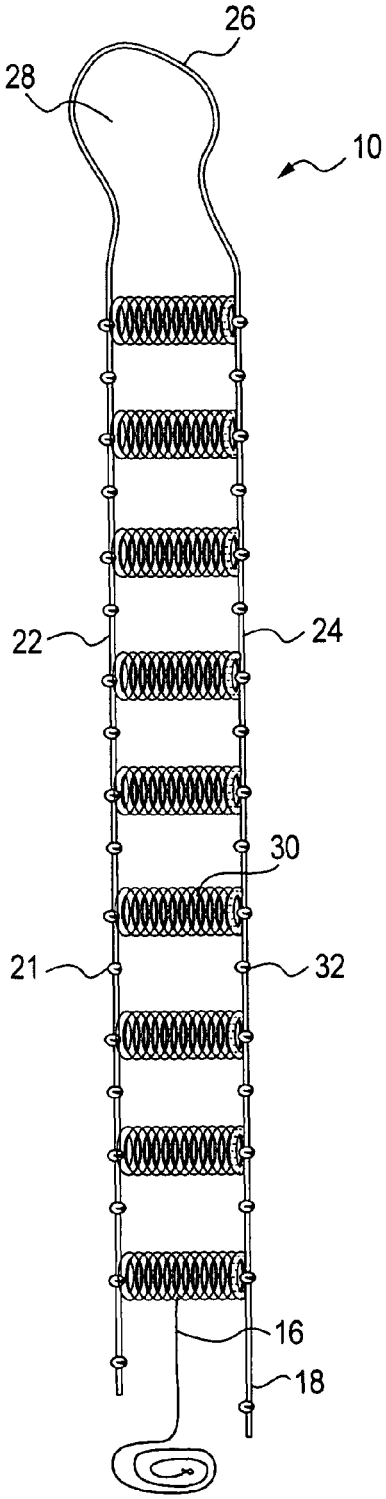
FIG. 2A shows the construction details of the safety ladder portion of the present invention.
Figure 2B:
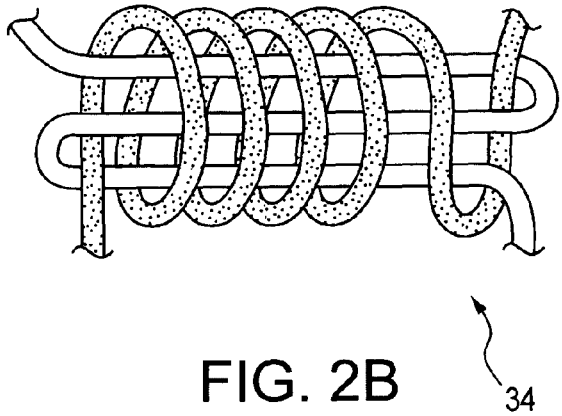
FIG. 2B illustrates the details of the preferred method for the knotting which is necessary to create the rungs of the ladder shown in FIG. 2A.
Figure 2C:
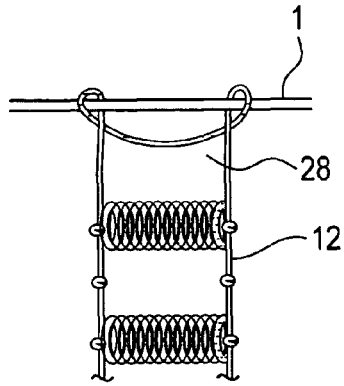
FIG. 2C illustrates a preferred way for attaching the safety ladder of FIG. 2A to a boat railing.

FIGS. 2A-2C shows construction details of this safety ladder 12 and a preferred method for attaching it to the horizontal railing 1 of a boat. The ladder is seen to be constructed from a continuous piece of rope 21 which has been knotted in a certain manner so as to provide two side pieces 22, 24 which come together at the top 26 of the ladder to form a loop 28 which proves useful in attaching the ladder to the boating's railing. The fact that the rope is continuous should be recognized as being quite beneficial in that it eliminates the likelihood of failures at any joints or connections that might otherwise exist in the ladder.

Figure 4A:
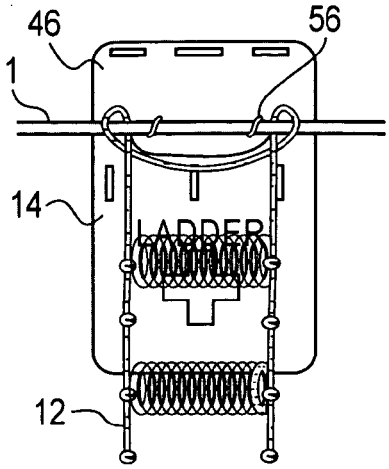
FIGS. 4A-4D illustrates the key steps in installing a preferred embodiment of the present apparatus on the horizontal railing of a boat.
Figure 4B:
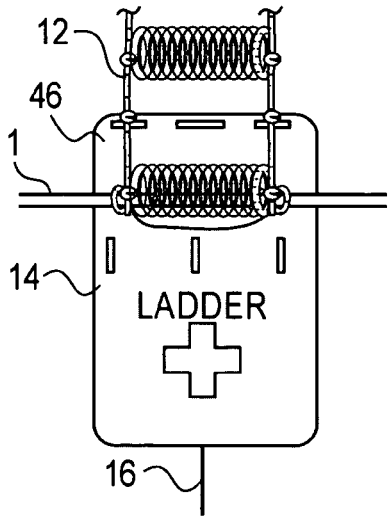
Figure 4C:
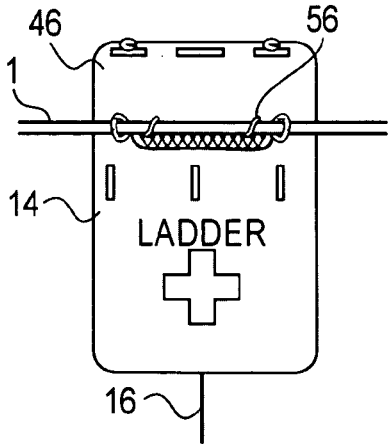
Figure 4D:
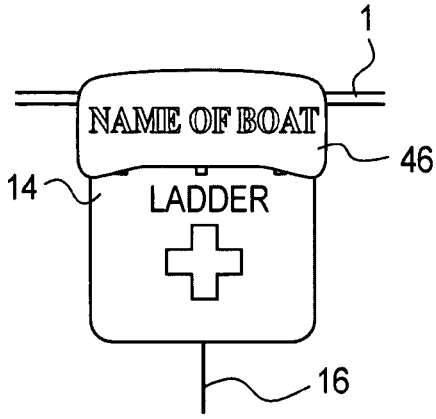

The rope's side pieces are separated by a number of uniformly spaced rungs 30 which are to be used as steps by one who is ascending the ladder. As seen in FIGS. 2C and 4A, the length of the loop 28 which is at the top of the ladder 12 and extends above its top rung is set so as to allow this loop to be placed adjacent or proximate to a boat's horizontal railing and then spread sufficiently wide so that the loop encompasses an area of sufficient size so as to both allow the rung portion of the ladder (i.e., the portion of the ladder below the loop) to be folded back through this loop as part of the process for attaching the ladder to a boat's horizontal railing and so as to position the ladder's top rung sufficiently close to the boat's top railing so that one who is using the ladder can easily reach from this top rung and use the boat's top railing as an aid in climbing over this railing to get back onto the boat. A significant advantage to this configuration and this process for attaching the ladder to the boat is that no additional parts, attachment means or tools are needed to install this ladder. On the side pieces, between the rungs are individual knots 32, or other appropriate gripping aids or means for gripping, which have been added to give one additional gripping power as they place their hands on the side pieces when climbing the ladder. The ladder's pull rope 16 is attached near the free end 18 of the ladder.

The details of the preferred method for the knotting 34 which is necessary to create the rungs of this ladder are shown in FIG. 2B. This knotting technique is the same as that used in the previously referenced "Knotted Bathing Ladder" (p590, *The Ashley Book of Knots*, Doubleday & Co., 1944). FIG. 2C illustrates the preferred way for attaching the ladder's top loop 28 to a boat railing 1.

It has been found advantageous to select a rope material to use in this ladder's construction that has the property that it is less dense than water so that the ladder will float. Commercially available, brightly colored (e.g., yellow—for increased visibility) one-half inch diameter, polypropylene ropes, with their high tolerance for exposure to marine environments, have proved to work very well in constructing the safety ladders of the present invention. However, they are susceptible to damage and deterioration due to excessive exposure to the sun's UV radiation. This potential problem is remedied by the present invention's selection of a UV-resistant case or covering 14 for the ladder.

Figure 3A:
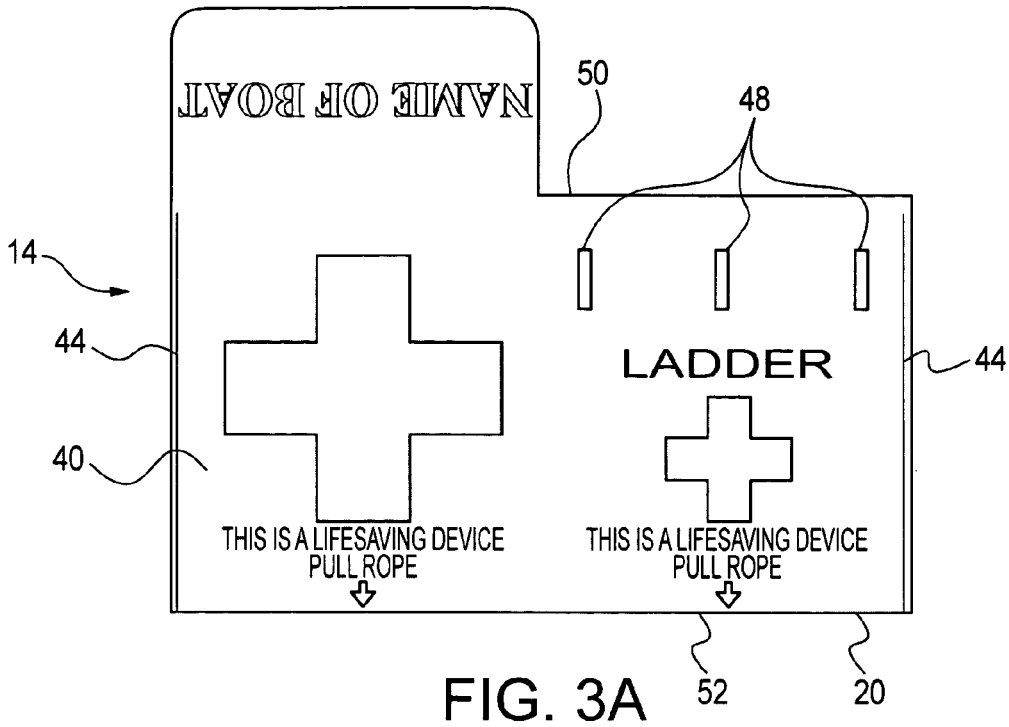
FIGS. 3A-3B show preferred construction details for the outside, 3A and inside, 3B surfaces of the piece of canvas material that is used to form this invention's case or covering.
Figure 3B:
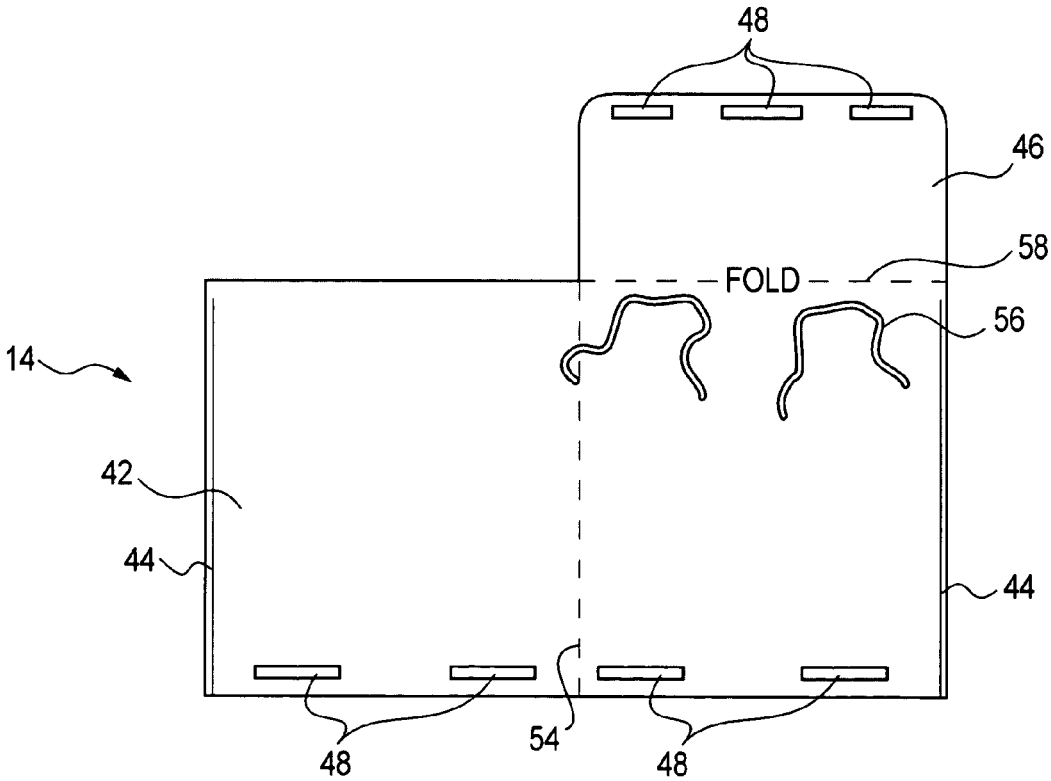

FIGS. 3A-3B show preferred construction details for the outside 40 and inside 42 surfaces of the piece of canvas material, or other light-weight, UV-resistant fabric, before its 44 edges are sewn together, that forms this invention's UV-resistant case or covering 14. The pattern for this piece is seen to be cut so that, when folded, it forms the front and rear pieces of a rectangular sleeve or tube with a top flap 46 that extends from the top portion of its rear piece. Pieces of hook and loop fastening material or fasteners 48 are added on the flap and near the sleeve's top 50, inside edge to allow for releasable closure or fastening of the flap. FIGS.4A-4D show that this flap is sized or configured such that it can wrap around a boat's horizontal railing and extend down so as to provide a covering for the ladder's top loop and also overlap the covering's front piece sufficiently so as allow the flap's hook and loop fastening material to connect to similar hook and loop fasteners 48 that have been placed on the outside surface of the covering's front piece near its top edge. The flap's ability to wrap around a boat's horizontal railing and be fastened shut provides one way for attaching this covering to a ladder which is to be protected by the covering.

Similar pieces 48 are placed near the sleeve's bottom edge 52 and are used to releasably attach together the two sides that result from folding this material along it's vertical fold line 54. Rope ties or other fastening means 56 near the flap's fold line 58 are provided to secure the covering 14 to a boat's horizontal railing, or directly to the ladder's top loop, at points proximate where the ladder's top loop 28 is attached to the railing. A significant advantage of this fabric covering is that no additional parts, other than the rope ties that are built directly into the covering, or tools are needed to install the covering and that its light-weight nature means that it can be attached directly to the ladder's loop rather than on the horizontal railing.

FIGS. 4A-4D illustrates the key steps in installing the present apparatus 10 on the horizontal railing 1 of a boat. After the ladder's top loop 28 is attached to the railing (see FIG. 1C), the covering 14, with its top flap open, is attached by its rope ties 56 to the railing, see FIG. 4A. Ensuring that the bottom of the sleeve is closed, the ladder 12 is raised and packed into the covering 14, bottom end first, taking care to ensure that the bottom end of the pull rope 16 passes thru the bottom of the covering, see FIG. 4B. Once the ladder 12 is fully packed within the covering, see FIG. 4C, the covering's top flap 46 is closed to further protect the ladder from the surrounding environment, see FIG. 4D. Extending the bottom end of the pull rope down to near the water's surface completes the ladder's installation.

Figure 5A:
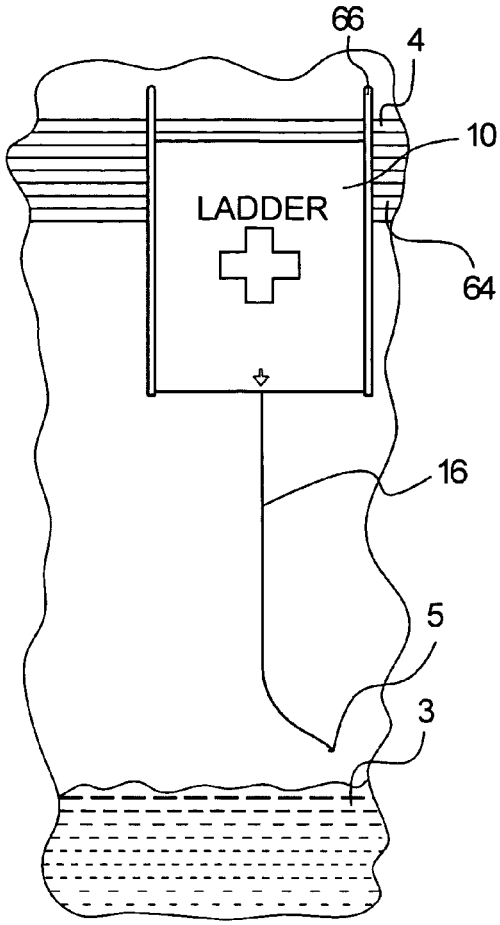
FIG. 5A illustrates the installation of a preferred embodiment of the present invention which is adapted for mounting on a pier and utilizes a modified covering.

It should of course be realized that the present invention can prove to be a very useful marine safety apparatus in other installation situations than just that of a horizontal boat railing. For example, the present invention can easily be mounted on a pier surface 4 such as a vertical one that extends down into the water, see FIG. 5A.

If the pier already has a fastening means (e.g., some sort of a hook) to which the ladder's upper loop can be attached, the previous embodiments can work satisfactorily in this application, with possibly a minor modification of the covering 14 to ensure that it can cover the pier's fastening means while also securely holding the ladder until one pulls its pull rope to deploy the ladder. In installations such as this, it may prove useful to provide a hook 5 near the water's surface which can temporarily secure the end of the pull rope 16 so as to keep it out of the way of any marine vessels that are passing in the area where the end of the pull rope would otherwise be hanging free.

Figure 5B:
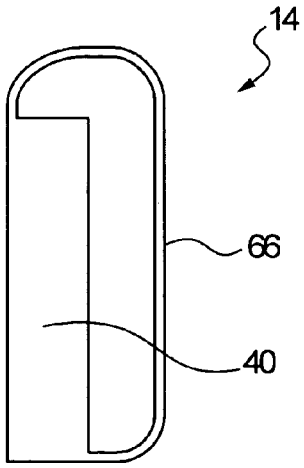
FIG. 5B shows a side view of the covering shown in FIG. 5A.
Figure 5C:
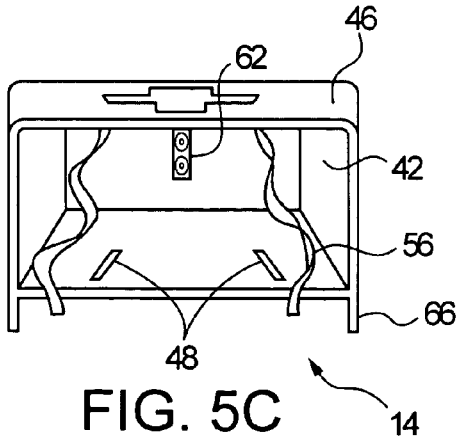
FIG. 5C shows a top view of the covering shown in FIG. 5A.

Alternatively, if the pier does not have a ladder fastening means, the covering 14 can be modified so that it incorporates such a ladder fastening means 62 while also providing a means for attaching 64 the covering, including the attachment means, to a pier surface 4. See FIGS. 5B-5C which respectively show a left side and a top (with the covering's top flap open and the ladder removed so as to reveal the inside of the covering or sleeve) view of a covering 14 that is suitable for this application. In this instance, the covering is made from a rigid plastic. It has hand rails 66, or other similar gripping or holding means, attached to its sides which help one to climb over this plastic covering (using the top of the flap as a step) so as to get onto the top 5 of the pier. Hook and loop fasteners 48 again provide a means for temporarily securing the covering's flap and its bottom so that it can support the ladder's weight until the pull rope is pulled.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention that is hereinafter set forth in the claims to this invention.

I claim:

1. A portable, marine emergency rope ladder apparatus that is to be attached to a horizontal railing above the surface of surrounding water, said apparatus comprising:

a continuous piece of rope knotted so as to form a ladder having a top and a bottom-free end, two side pieces that form a loop at the top of said ladder for attaching said ladder to said horizontal railing, and a plurality of rungs extending between said side pieces, said loop having a length that allows said loop to be placed proximate to said horizontal railing and then spread so as to encompass a loop area which allows the portion of the ladder below said loop to be passed around said horizontal railing and through said loop area to thereby attach said ladder to said horizontal railing, a pull rope having top and bottom ends, with said top end attached proximate the free end of said ladder, a covering configured to accommodate said ladder within said covering, said covering having front and rear pieces, both of which include top and bottom portions and a flap that extends from said top portion of said rear piece and is configured such that said flap can wrap around said horizontal railing and extend down so as to both provide a covering for said loop and allow for the attachment of said covering to said horizontal railing, said covering also having a plurality of hook and loop fastener that are attached to the inside surface of said bottom portions of said pieces for releasably connecting said pieces so that said covering can support the weight of said ladder when said ladder is placed within said covering, wherein said pull rope having a length such that said rope bottom end can be extended to proximate said water surface when said ladder is within said covering, and wherein said hook and loop fasteners further configured so that a pull on said pull rope causes said hook and loop fasteners to open said covering bottom portions so as to allow said ladder free end to drop to said water surface.

2. The marine emergency rope ladder apparatus as recited in claim 1, wherein said rope is made from a material that allows said ladder to float on water.

3. The marine emergency rope ladder apparatus as recited in claim 1, said apparatus further comprising:

a plurality of gripping knots located on said ladder side pieces, with one of said knots being located between each of said ladder rungs for aiding one to grip said side pieces when trying to climb said ladder.

4. The marine emergency rope ladder apparatus as recited in claim 2, said apparatus further comprising:

a plurality of gripping knots located on said ladder side pieces, with one of said knots being located between each of said ladder rungs for aiding one to grip said side pieces when trying to climb said ladder.

5. The marine emergency rope ladder apparatus as recited in claim 1, wherein said covering is a UV-resistant fabric.

6. The marine emergency rope ladder apparatus as recited in claim 4, wherein said covering is a UV-resistant fabric.

7. The marine emergency rope ladder apparatus as recited in claim 1, further comprising rope ties attached to said covering proximate said top portion of said covering for attaching said covering to said rope loop once said ladder has been attached to said horizontal railing.

8. The marine emergency rope ladder apparatus as recited in claim 6, further comprising rope ties attached to said covering proximate said top portion of said covering for attaching said covering to said rope loop once said ladder has been attached to said horizontal railing.

9. The marine emergency rope ladder apparatus as recited in claim 1, wherein said rope is brightly colored and made of polypropylene.

10. The marine emergency rope ladder apparatus as recited in claim 8, wherein said rope is brightly colored and made of polypropylene.

* * * * *